US006260452B1

(12) United States Patent
Yu

(10) Patent No.: US 6,260,452 B1
(45) Date of Patent: Jul. 17, 2001

(54) TWO-AXLE TOOL

(76) Inventor: Hsiu-E Yu, No. 921-11, Chung Shan Rd., Section 2, Ta Chia, Taichung Hsien (TW)

( * ) Notice: Subject to any disclaimer, the term of this patent is extended or adjusted under 35 U.S.C. 154(b) by 0 days.

(21) Appl. No.: 09/748,780

(22) Filed: Dec. 27, 2000

(51) Int. Cl.[7] ..... B25B 23/16
(52) U.S. Cl. ..... 81/177.2; 81/177.85; 81/177.9
(58) Field of Search ..... 81/177.2, 177.85, 81/177.5, 177.8, 177.9

(56) References Cited

U.S. PATENT DOCUMENTS 198,544 * 12/1877 Kettlewell ..... 81/177.85
2,819,637 * 1/1958 Pierre ..... 81/177.9
2,963,930 * 12/1960 Clothier et al. ..... 81/177.2
3,416,395 * 12/1968 Hanson ..... 81/177.5
4,485,702 * 12/1984 Swan et al. ..... 81/177.2
5,515,754 * 5/1996 Elkins ..... 81/177.9
5,797,300 * 8/1998 Fairbanks ..... 81/177.2
6,044,733 * 4/2000 Liu ..... 81/177.2
6,145,413 * 11/2000 Lin ..... 81/177.2

* cited by examiner

*Primary Examiner*—James G. Smith
*Assistant Examiner*—Hadi Shakeri

(57) ABSTRACT

A tool includes a shaft with a polygonal rod movably received therein and the polygonal rod has an engaging end. A connection member is pivotally connected to an end of the shaft and another polygonal rod movably extends through the connection member. Two engaging ends are connected to two ends of the polygonal rod connected to the connection member. Each engaging end is cooperated with a socket. The connection member is pivoted to let the two polygonal rods be located in parallel with each other.

2 Claims, 6 Drawing Sheets

TWO-AXLE TOOL

FIELD OF THE INVENTION

The present invention relates to a socket tool that has two axles pivotally connected to each other and each axle has an engaging end for connecting a socket. The two axles can be folded to be parallel with each other so as to be convenient for storage.

BACKGROUND OF THE INVENTION

A conventional socket tool generally includes a shaft has an engaging end so that sockets with different sizes can be connected to the engaging end for different purposes. In other words, the user may remove a first socket from the engaging end and put a second socket on to deal with different sized objects. However, the replacement of sockets takes time and the replaced sockets could get lost. Besides, because the engaging end of the tool can only cooperate with specific sockets so that if a large object is unfastened, the user has to use other tool which has a larger engaging end to cooperate with a large-size socket.

The present invention intends to provide a two-axle tool that can output a large torque and the two axles can be folded with each other so as to become a compact size.

SUMMARY OF THE INVENTION

In accordance with one aspect of the present invention, there is provided a tool and comprising a shaft having a polygonal recess in a first end thereof and a first shoulder is defined in an outer periphery of the first end. A sleeve is movably mounted to the first end of the shaft and a ball is received in a hole in the first end of the shaft and pressed by the sleeve. A slot is defined in a second end of the shaft and a connection member is pivotally engaged with the slot. A polygonal passage is defined through the connection member and a first polygonal rod is movably extending through the polygonal passage. Each one of two ends of the first polygonal rod has an engaging end. A second polygonal rod is movably received in the polygonal recess and has a plurality of dents defined in an outer surface thereof so that the ball is engaged with one of the dents. An engaging end is connected to an end of the polygonal rod.

The primary object of the present invention is to provide a tool that has two polygonal rods which can be positioned as a T-shaped tool, and the two polygonal rods have at least three engaging ends for connecting with sockets.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
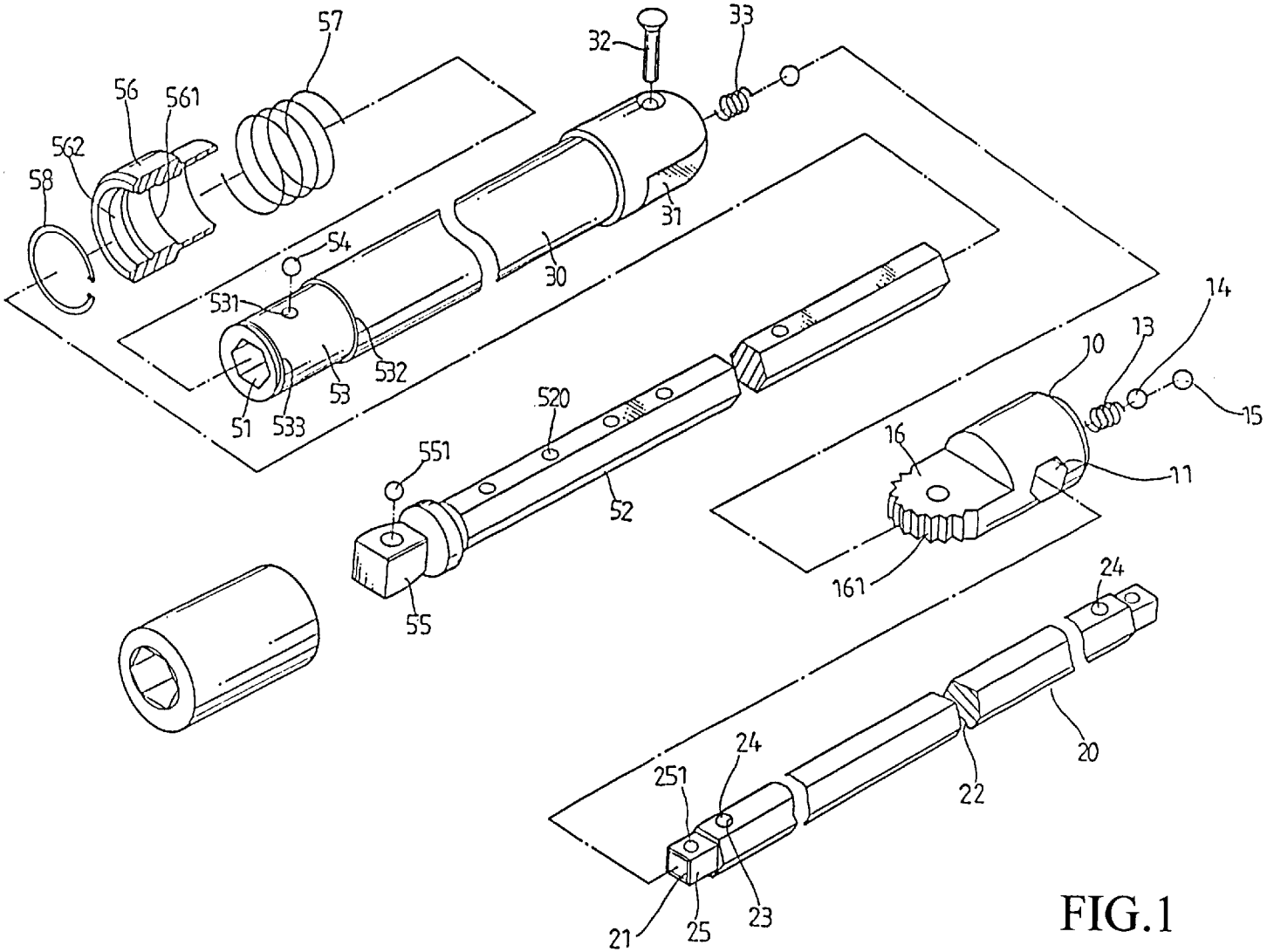
FIG. 1 is an exploded view to show a tool of the present invention.
Figure 2:
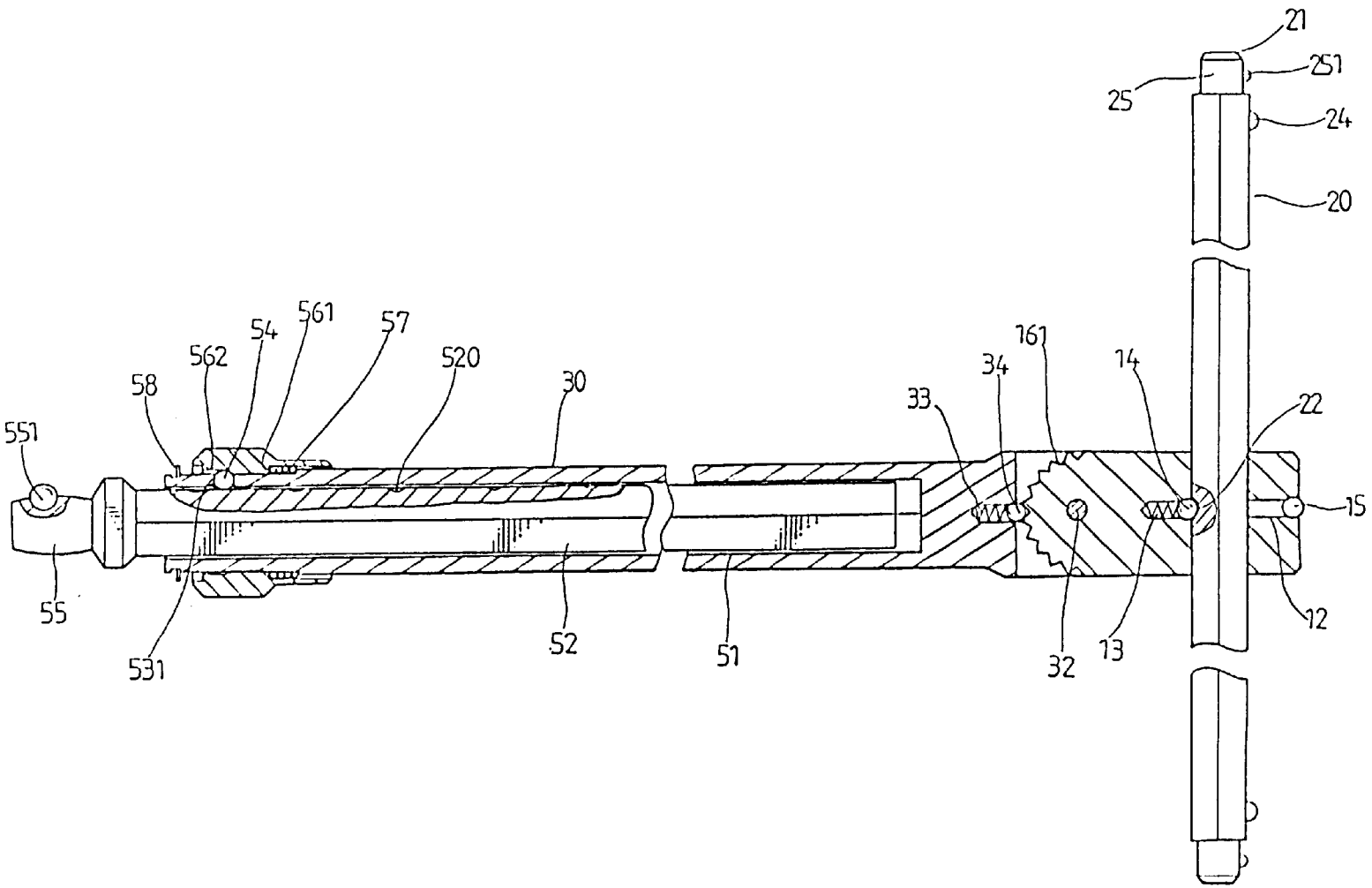
FIG. 2 is a cross sectional view to show the tool of the present invention.
Figure 3:
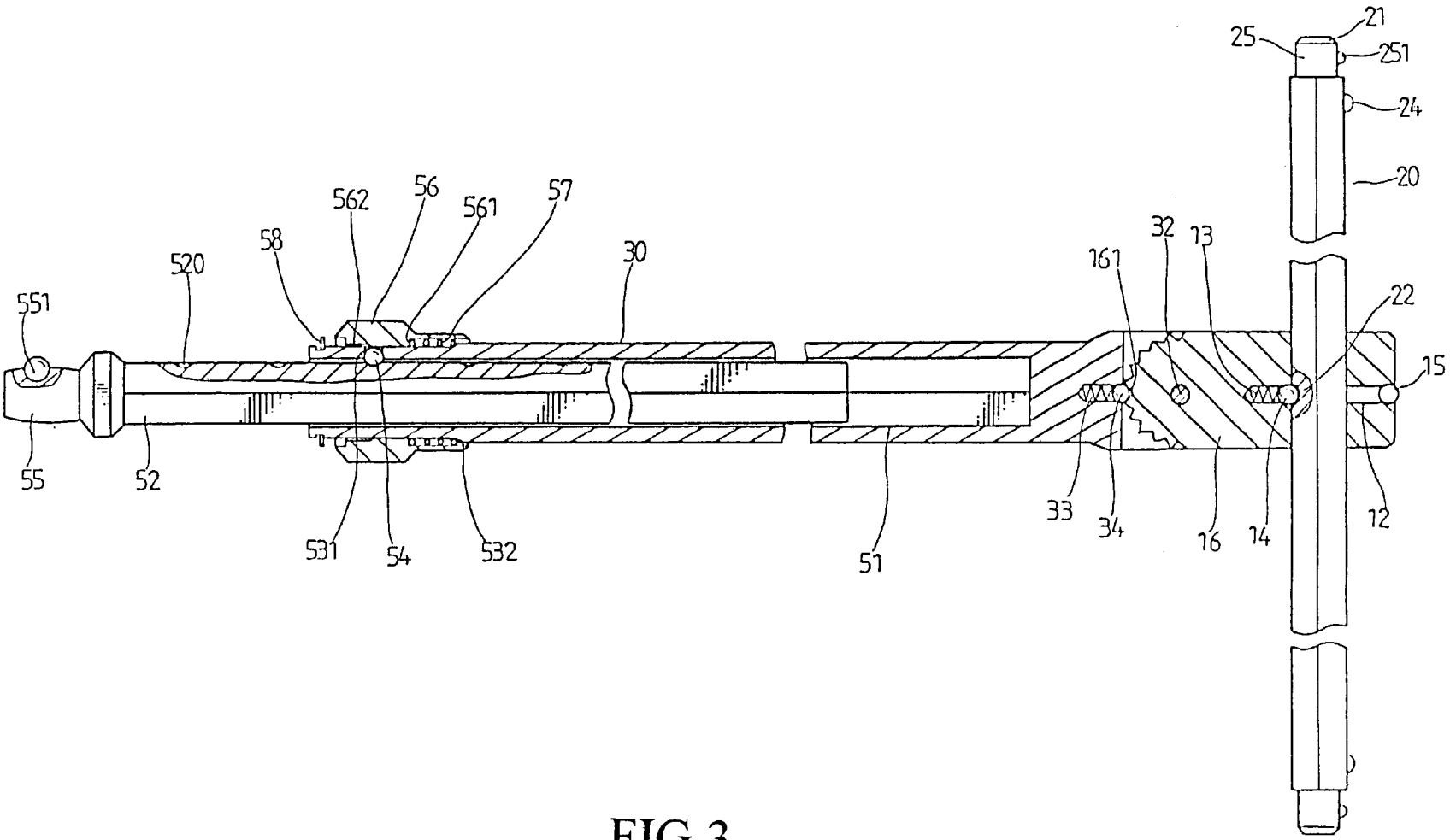
FIG. 3 is a cross sectional view to show the tool of the present invention wherein the second polygonal rod is extended from the shaft.

Referring to FIGS. 1 to 3, the tool of the present invention comprises a shaft 30 having a polygonal recess 51 defined longitudinally in a first end 53 of the shaft 30 and a first shoulder 532 is defined in an outer periphery of the first end 53. A first hole 531 is defined radially through the first end 53 and a first ball 54 is engaged with the first hole 531. A groove 533 is defined in an outer periphery of the first end 53 of the shaft 30 so as to receive a C-shaped clamp 58 therein. A sleeve 56 has a groove 562 defined in an inner periphery thereof and a second shoulder 561 extends from the inner periphery of the sleeve 56. The sleeve 56 is movably mounted to the first end 53 and a spring 57 is mounted to the first end 53 of the shaft 30 and engaged between the first shoulder 532 and the second shoulder 561. The sleeve 56 is stopped by the C-shaped clamp 58 so as not to drop from the first end 53 of the shaft 30.

Figure 4:
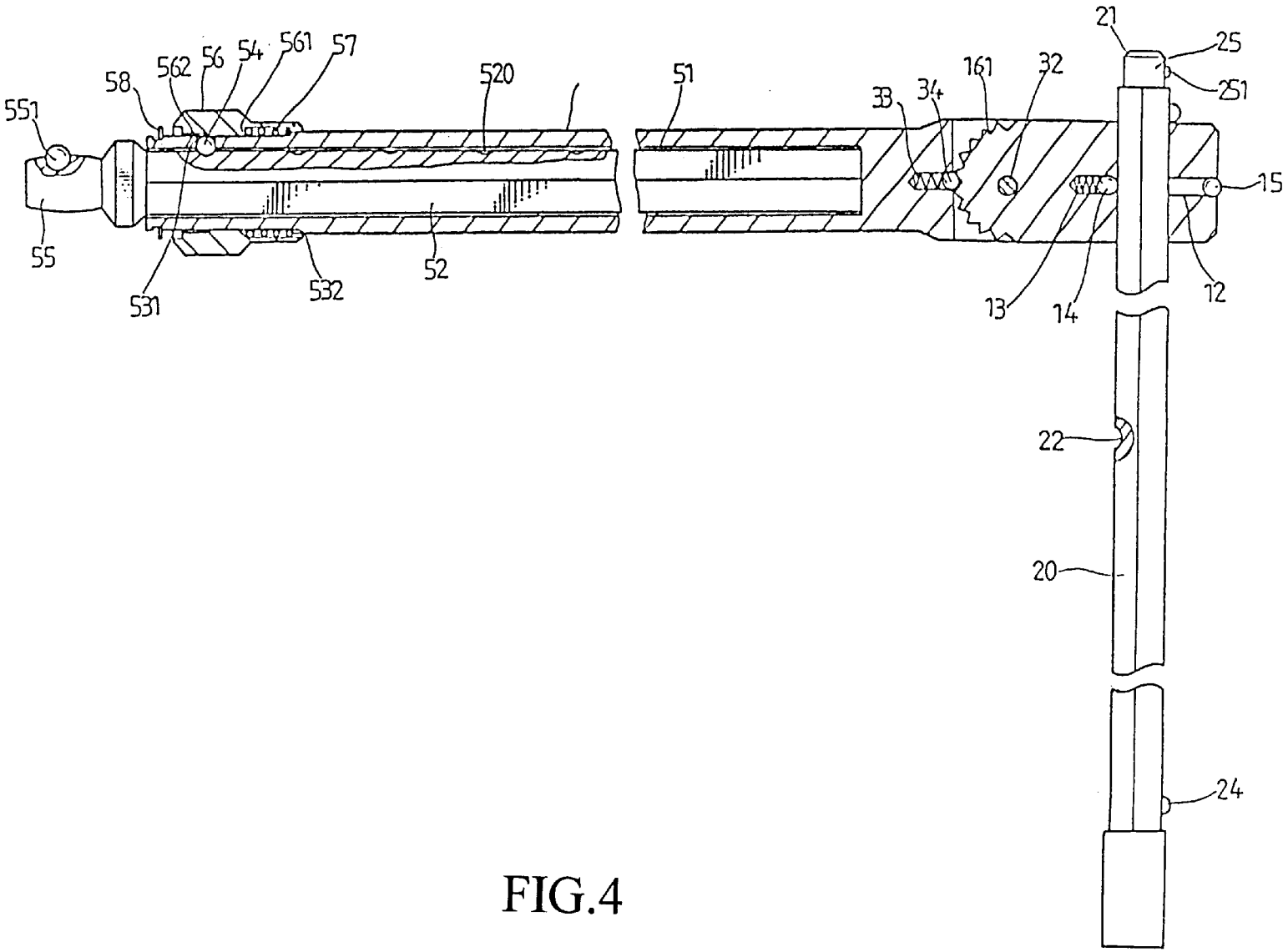
FIG. 4 is a cross sectional view to show the tool of the present invention wherein the first polygonal rod is located to an extreme position to make the tool as a L-shaped tool.

A slot 31 is defined in a second end of the shaft 30 and a connection member 10 is pivotally engaged with the slot 31. The connection member 10 has a plate 16 pivotally received in the slot 31 by a pin 32 and the plate 16 has a serrated periphery 161. A first recess is defined in the second end of the shaft 30 and a ball 34 and a spring 33 are received in the first recess in the second end of the shaft 30. The ball 34 is engaged with the serrated periphery 161 of the plate 16 to position the connection member 10. A polygonal passage 11 is radially defined through the connection member 10 and a first polygonal rod 20 movably extends through the polygonal passage 11. Each one of two ends of the first polygonal rod 20 has an engaging end 25. Each engaging end 25 has a ball 251 extending therefrom and each end of each engaging end 25 has rounded periphery 21 so as to be easily engaged with a socket. Two protrusions 24 extend from two ends of the first polygonal rod 20 so as to prevent the first polygonal rod 20 from dropping from the polygonal passage 11 as shown in FIG. 4. A second recess is defined radially in an inner periphery of the polygonal passage 11 and a ball 14 and a spring 13 are received in the second recess. The second recess is machined by way of making a long passage 12 through the connection member 10 and the long passage 12 passes through the polygonal passage 11. A end member 15 is then sealed the long passage 12. A notch 22 is defined in a mediate position of the first polygonal rod 20 and can be engaged with the ball 14 in the second recess as shown in FIGS. 2 and 3.

Figure 6:
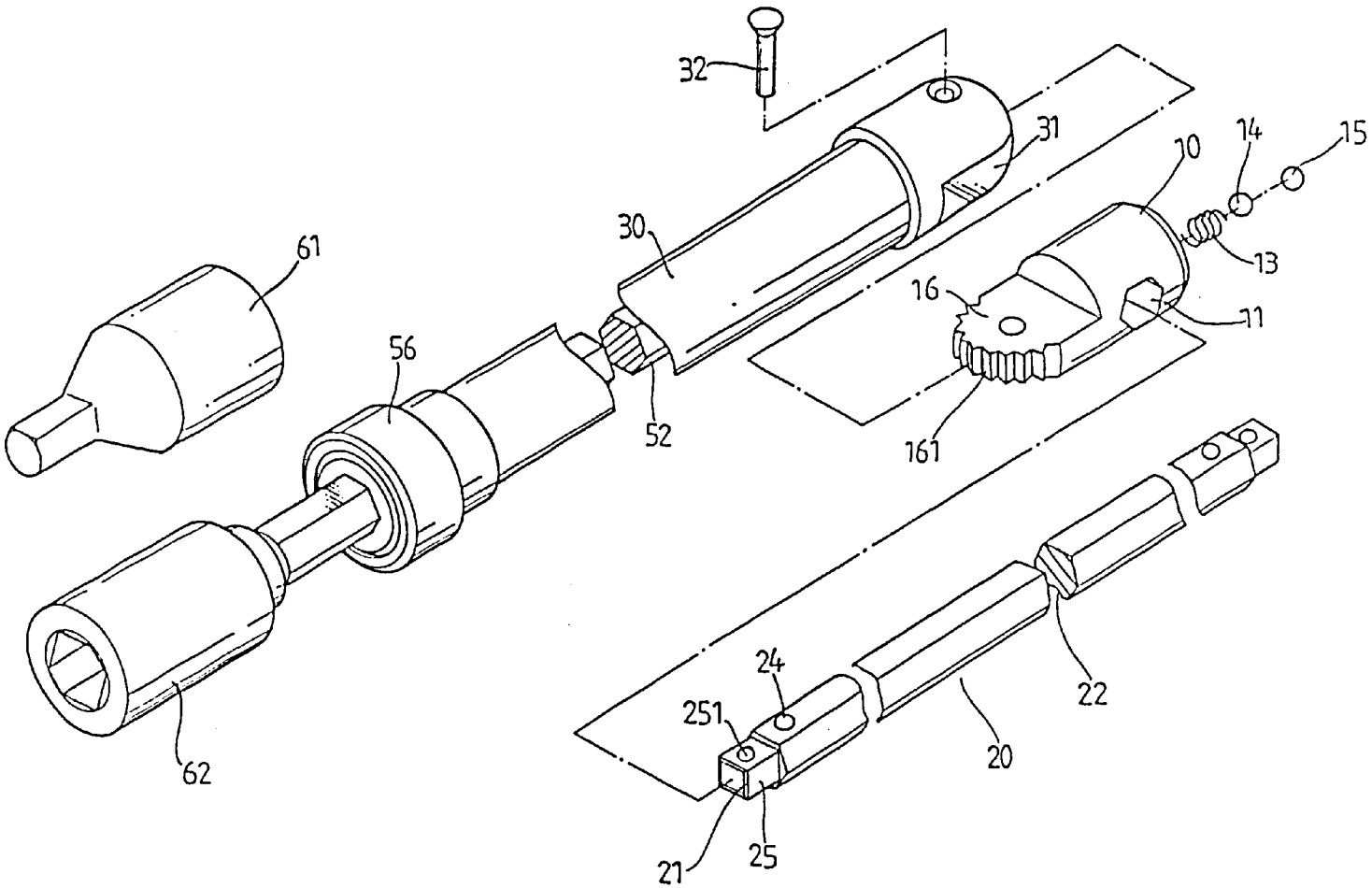
FIG. 6 is an exploded view to show that the tool of the present invention can be cooperated with different types of bits and sockets.

A second polygonal rod 52 is movably received in the polygonal recess 51 and has a plurality of dents 520 are defined in an outer surface thereof an engaging end 55 is connected to an end of the polygonal rod 52. The first ball 54 is engaged with one of the dents 520 to position the second polygonal rod 52. As shown in FIG. 2, when pulling the sleeve 56 toward the connection member 10, the first ball 54 is partially received in the groove 562 so that the second polygonal rod 52 can be moved in the polygonal recess 51. When releasing the sleeve 56, the sleeve 56 is moved back by the spring 57 and the first ball 54 is pressed by the inner periphery of the sleeve 56 to position the second polygonal rod 52 as shown in FIG. 3. As shown in FIG. 6, each engaging end 55, 25 can be cooperated with different types of bits 61 and sockets 62. The first polygonal rod 20 can be used as an arm of force when using the second polygonal rod 52, and vice versa. Therefore, the tool includes two axles which is convenient to be used in different situations.

Figure 5:
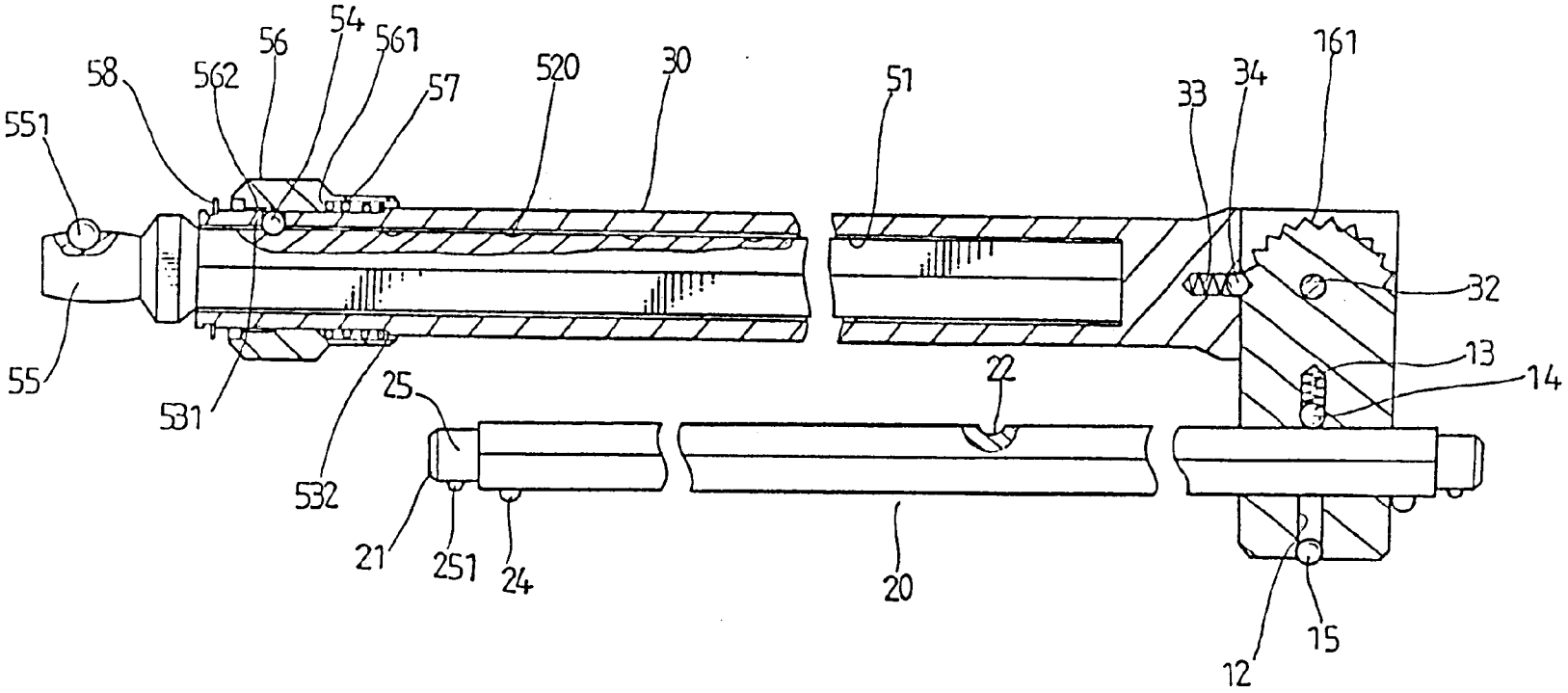
FIG. 5 is a cross sectional view to show the two polygonal rods are folded to be in parallel with each other.

As shown in FIG. 5, when the connection member 10 is pivoted to be perpendicular to the shaft 30, the first polygonal rod 20 is located in parallel with the second polygonal rod 52. By this way, the tool occupies a limit space and is convenient for storage.

While we have shown and described various embodiments in accordance with the present invention, it should be clear to those skilled in the art that further embodiments may be made without departing from the scope and spirit of the present invention.

What is claimed is:

1. A tool comprising:

a shaft having a polygonal recess defined longitudinally in a first end of said shaft, a first shoulder defined in an outer periphery of said first end, a first hole defined radially through said first end and a first ball engaged with said first hole, a slot defined in a second end of said shaft and a connection member having a plate which is pivotally engaged with said slot, said plate having a serrated periphery, a first recess defined in said second end of said shaft and a ball and a spring received in said first recess in said second end of said shaft, said ball engaged with said serrated periphery of said plate, a polygonal passage defined radially through said connection member and a first polygonal rod movably extending through said polygonal passage, two protrusions extending from two ends of said first polygonal rod so as to prevent said first polygonal rod from dropping from said polygonal passage, each one of two ends of said first polygonal rod having an engaging end;

a sleeve having a groove defined in an inner periphery thereof and a second shoulder extending from said inner periphery of said sleeve, said sleeve movably mounted to said first end, a spring mounted to said first end of said shaft and engaged between said first shoulder and said second shoulder, and a second polygonal rod movably received in said polygonal recess and having a plurality of dents defined in an outer surface thereof, said first ball engaged with one of said dents, an engaging end connected to an end of said polygonal rod.

2. The tool as claimed in claim 1 further comprising a second recess defined radially in an inner periphery of said polygonal passage and a ball and a spring received in said second recess, a notch defined in said first polygonal rod and engaged with said ball in said second recess.

* * * * *